US007220170B2

(12) United States Patent
Boccia

(10) Patent No.: US 7,220,170 B2
(45) Date of Patent: May 22, 2007

(54) BLADE SHARPENING MACHINES

(75) Inventor: Maurizio Boccia, Rome (IT)

(73) Assignee: Dima S.N.C Di Boccia M. & C., Rome (IT)

( * ) Notice: Subject to any disclaimer, the term of this patent is extended or adjusted under 35 U.S.C. 154(b) by 0 days.

(21) Appl. No.: 11/328,768

(22) Filed: Jan. 10, 2006

(65) Prior Publication Data

US 2006/0160469 A1 Jul. 20, 2006

(30) Foreign Application Priority Data

Jan. 14, 2005 (IT) ..... RM2005A0018

(51) Int. Cl.
*B24B 1/00* (2006.01)

(52) U.S. Cl. ..... 451/45; 451/56; 451/443

(58) Field of Classification Search ..... 451/45, 451/272, 56, 57, 443, 193; 125/11.01
See application file for complete search history.

(56) References Cited

U.S. PATENT DOCUMENTS

| | | | | |
|---|---|---|---|---|
| 3,881,889 | A * | 5/1975 | Hunkeler | 451/48 |
| 6,676,495 | B1 * | 1/2004 | Siemers et al. | 451/278 |
| 6,808,440 | B2 * | 10/2004 | Mundt | 451/48 |
| 2002/0137445 | A1 * | 9/2002 | Trigari | 451/272 |

* cited by examiner

*Primary Examiner*—Dung Van Nguyen
(74) *Attorney, Agent, or Firm*—Hedman & Costigan P.C.; James V. Costigan

(57) ABSTRACT

The invention concerns a blade sharpening machine that can be driven either by manual or automatic control. The blade sharpening machine possess two rotating grinding wheels and a mechanism for supporting the blade to be sharpened so that said blade can be sharpened in contact with the lateral surface of a rotating grinding wheel.

5 Claims, 4 Drawing Sheets

BLADE SHARPENING MACHINES

This application claims priority to Italian Application No. RM2005A000018 filed on Jan. 14, 2005.

The present invention relates to a blade-sharpening machine. More specifically, the invention concerns a machine of the above kind allowing carrying out blade sharpening under maximum safety conditions, very easily and with minimum wearing of the blade when sharpening the same.

BACKGROUND OF THE INVENTION

Field of the Invention

As it is well known, more or less automatic machines exists since many years for sharpening every king of blade, and particularly for sharpening knives.

Substantially, said machine provide a rotating grinding wheel, on the outer peripheral surface of which the blade to be sharpened is approached with contact.

Usually, approaching step of the blade to the grinding wheel occurs on the outer surface of the grinding wheel disc, and a skilled workman carries it out manually.

This involves a number of remarkable problems both under a practical and operative point of view.

First of all, quality of sharpening is relied upon the capability of the workman, who, unavoidably, consumes an amount of material higher than the one really necessary.

Furthermore, grinding wheel abrasive material is consumed during sharpening step, so that peripheral speed of the sharpening surface varies, increasing while the material is consumed, with a consequent increase of heat produced by the same grinding wheel on the blade, thus influencing properties of blade material.

Another problem encounters is that concerning the needing of periodically dressing the grinding wheel, since it provides an abrasive paste, thus being it necessary stopping the machine, consequently loosing productivity rate.

In view of the above, it is well evident that it is advantageous having a solution as the one proposed according to the present invention, permitting overcoming all the above-mentioned drawbacks.

BRIEF SUMMARY OF THE INVENTION

Main object of the present invention is that of providing a blade-sharpening machine by which the problem of the variation of the sharpening surface peripheral speed is solved.

Another object of the present invention is that of realising a machine not requiring a skilled workman to be operated.

Still another object of the present invention is that of providing a machine of the above kind allowing dressing the grinding wheel without stopping the operativity of the machine.

DETAILED DESCRIPTION OF THE INVENTION

It is therefore specific object of the present invention a blade sharpening machine comprising a support, operation means, manual and/or automatic control and driving means, said machine being characterised in that it provides a rotating grinding wheel and at least a support for the blade to be sharpened, said support being provided in such a position to bring the blade to be sharpened in contact with the lateral surface of the rotating grinding wheel, and being movable between an operative position and a rest position.

Preferably, according to the invention, said support for the blade to be sharpened is provided with tilting means for tilting the same with respect to the rotating grinding wheel lateral surface.

Particularly, according to the invention, two supports for the blade to be sharpened are provided, one in correspondence of each of the two rotating grinding wheel lateral surfaces.

DESCRIPTION OF THE PREFERRED EMBODIMENT

In a preferred embodiment of the present invention, said machine further provides means for dressing the grinding wheel surface, said dressing means acting on the grinding wheel at the same time when the sharpening operation occurs.

Particularly, according to the invention, said means for dressing the grinding wheel surface provide a dressing nose, preferably a diamond nose, mounted at the end of a support arm, said arm being movable reciprocably, so as to make the nose spanning the whole surface of the rotating grinding wheel in order to obtain a complete dressing.

Furthermore, according to the invention, means can be provided for approaching the dressing nose to the rotating grinding wheel surface as soon as the rotating grinding wheel surface consumes.

Always according to the invention, said machine provides a rotating grinding wheel protection.

BRIEF DESCRIPTION OF THE SEVERAL VIEWS OF THE DRAWINGS

The present invention will be now described, for illustrative but not limitative purposes, according to its preferred embodiments, with particular reference to the figures of the enclosed drawings, wherein.

Observing the figures of the enclosed drawings, it is shown an embodiment of a machine according to the invention, generically indicated by reference number 1.

Different operative components of the machine 1 are shown in the figures, such as motorisation components, control systems, ecc. that, although necessary for an optimum operation of the same, has not a specific function for obtaining the innovative features of the machine, and thus will be not described in greater detail in the following.

Figure 1:
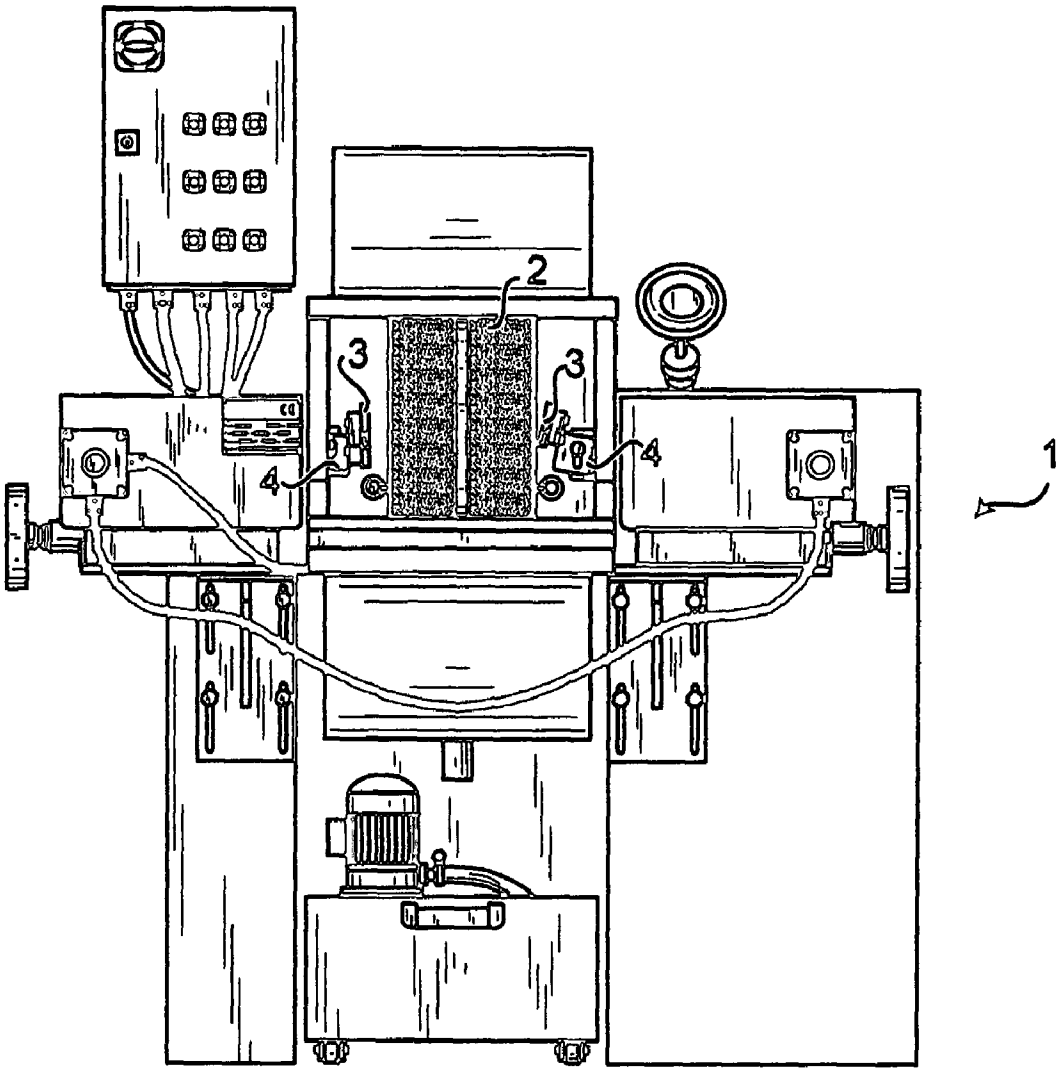
FIG. 1 is a first front view of a machine according to the invention.
Figure 3:
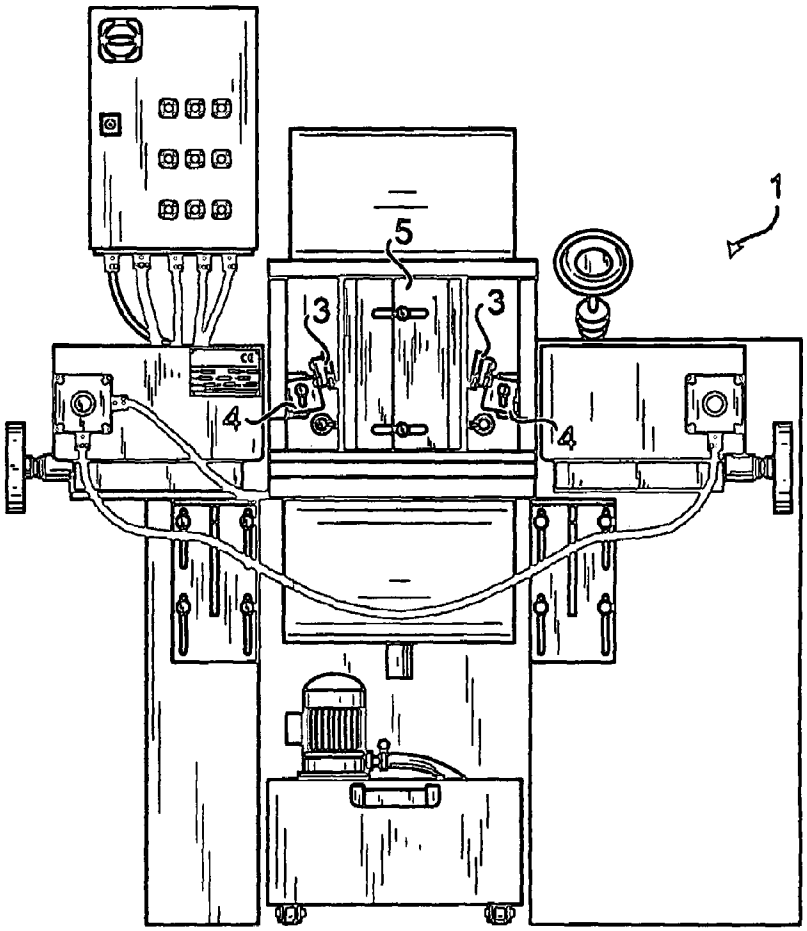
FIG. 3 is a third front view of a machine according to the invention.
Figure 2:
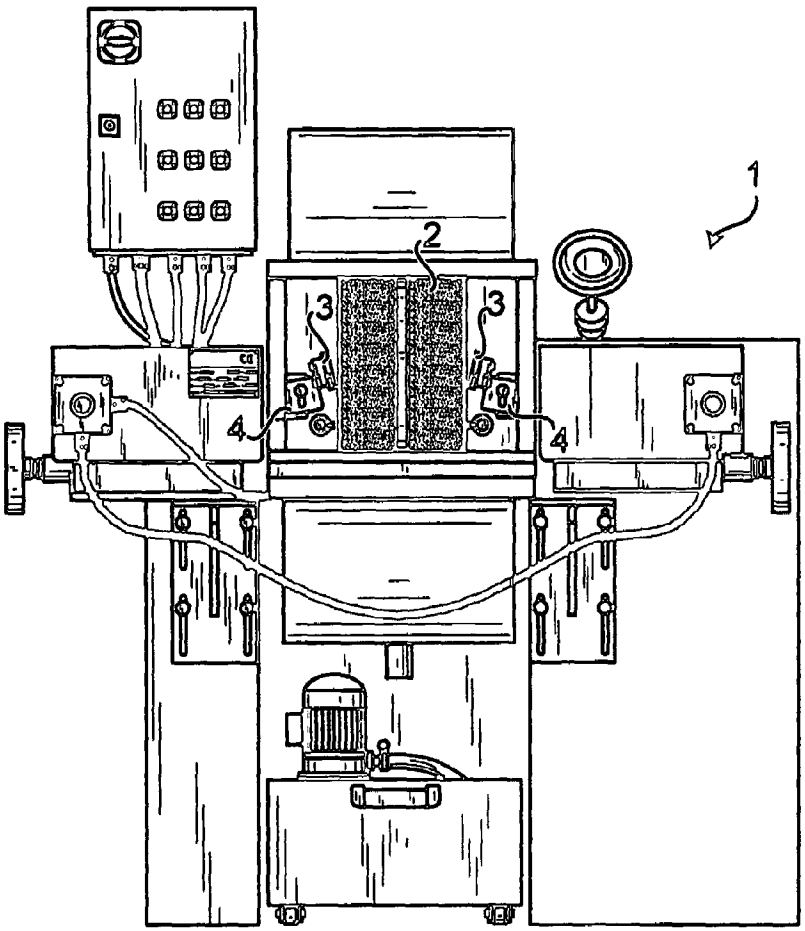
FIG. 2 is a second front view of a machine according to the invention.

As it can be noted observing first FIGS. 1–3, machine 1 provides a rotating grinding wheel 2, two supports 3 for the blade to be sharpened, that can be displaced between a sharpening position (support 3 on the right side of FIG. 1, both supports 3 of FIG. 2 and FIG. 3), and a rest position, said supports being provided with a blade tilting adjustment element 4. A protection 5 is further shown in FIG. 3 (while it is omitted from FIGS. 1 and 2 for clarity reasons), said protection being provided in the figure in front of the grinding wheel 2.

These figures allows individuating the main features of the machine according to the invention, since sharpening of the blades occurs on the lateral surface of grinding wheel 2, and not on the front surface, as in the known machines.

In this way, it is prevented an increase of the peripheral speed of the sharpening surface, since wearing of the lateral surface does not modify this parameter, and supports will approach the blade to be sharpened to the grinding wheel surface in an even way, this further involving an optimisation of the sharpening operation, without the needing of a skilled workman. It is further prevented the bothersome overheating of the blade caused by the increase of the sharpening surface peripheral speed, said overheating also influencing the properties of the blade material.

Approaching and moving away of supports 3 from the grinding wheel 2 lateral surface, as well as their tilting by elements 4, can be carried out manually or by automatic control.

Figure 4:
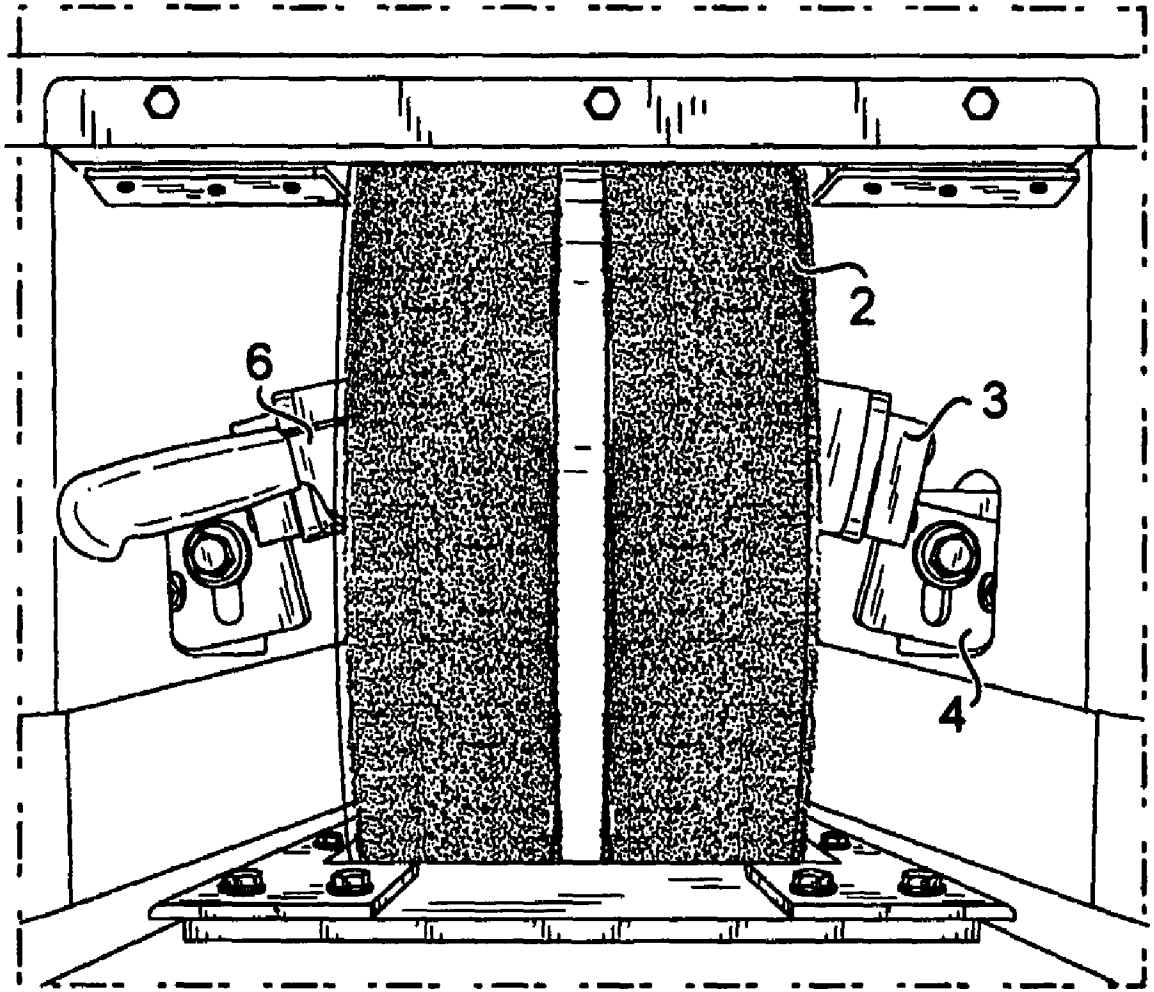
FIG. 4 shows a particular of the grinding wheel of the machine according to the invention.

Observing now in greater detail FIG. 4, it can be observed structure of grinding wheel 2, that in the embodiment shown is comprised of to glued grinding wheels, opposed on a metal flange, particularly for example two 05-600×100×396-440×90 9AR46M5V1 grinding wheels. Obviously, coupling of the two grinding wheels can be realised also by fixed joint, or by another method and system.

Figure 5:
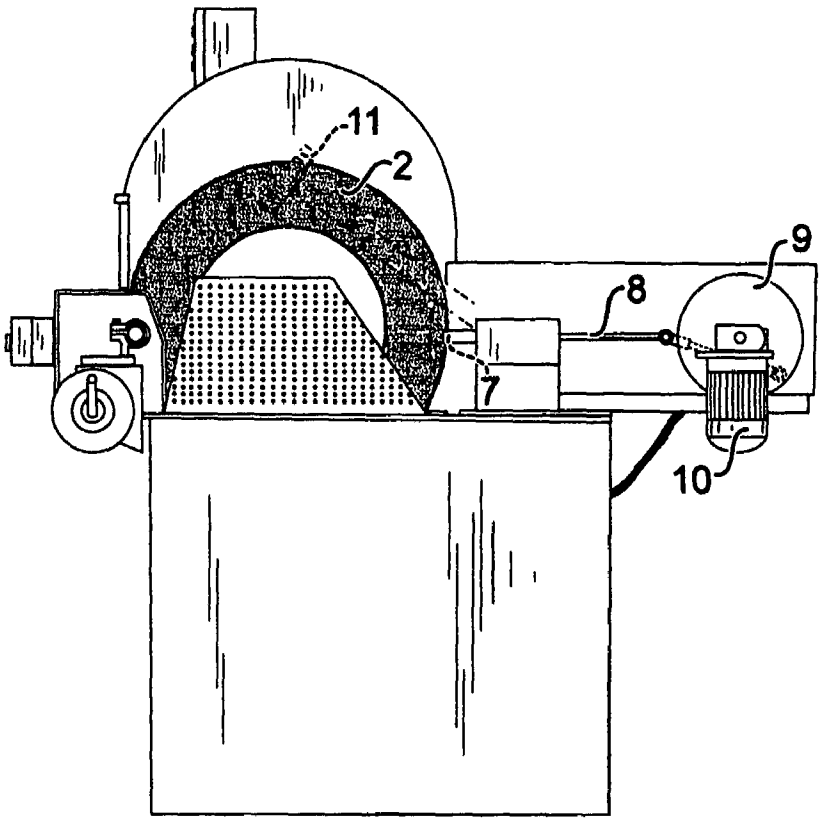
FIG. 5 shows a first rear view of the machine according to the invention.
Figure 6:
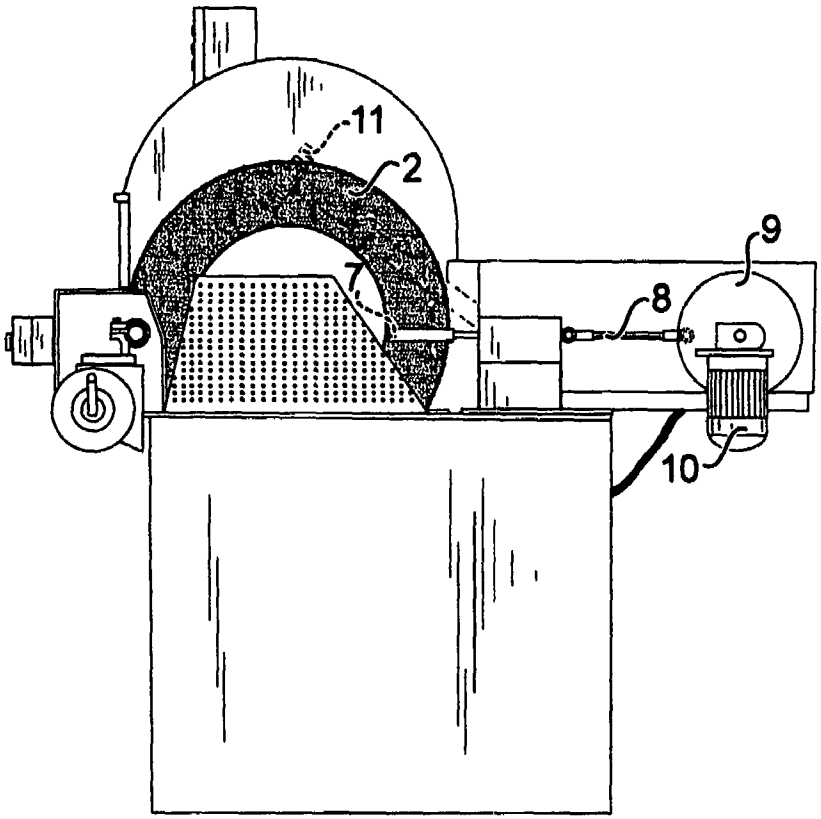
FIG. 6 shows a second rear view of the machine according to the invention.

Coming now to observe FIGS. 5 and 6, it is possible noting a further innovative feature of the machine 1 according to the invention. Particularly, it can be noted the solution allowing dressing the grinding wheel 2 surface while the same is used for sharpening the blade 6, without the needing of interrupting the operativity of the machine 1.

To this end, diamond noses 7 are provided, movable between two positions, respectively a rest position (FIG. 5) and an operative position (FIG. 6) by an arm 8, coupled with a rotating disk 9 and operated by a motor 10. Rotation of disk 9 horizontally moves nose 7 along the lateral surface of the grinding wheel 2, thus evenly dressing the same.

It is further provided a manual device 11, for approaching diamond noses 7 to the grinding wheel 2 surface, when the latter is consumed.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A Blade sharpening machine comprising a support, operation means, manual and/or automatic control and driving means, said machine being characterized in that it provides two rotating grinding wheels (2), at least one support structure (3) for the blade to be sharpened for each rotating grinding wheel, said support structure (3) being provided in such a position as to bring the blade to be sharpened in contact with a lateral surface of at least one of the two rotating grinding wheels, and being movable between an operative position and a rest position, said support structure (3) being provided with a blade tilting adjustment element (4) for altering the inclination of said support structure with respect to a lateral surface of at least one of the two rotating grinding wheels.

2. The blade sharpening machine according to claim 1, characterized in that said machine further provides means for dressing the grinding wheel surface, said dressing means acting on the grinding wheel at the same time when the sharpening operation occurs.

3. The blade sharpening machine according to claim 2, characterized in that said means for dressing the grinding wheel surface provide a dressing nose, preferably a diamond nose, mounted at the end of a support arm, said arm being movable reciprocally, so as to make the nose spanning the whole surface of the rotating grinding wheel in order to obtain a complete dressing.

4. The blade sharpening machine according to claim 2, characterized in that means are provided for approaching the dressing nose to the rotating grinding wheel surface as soon as the rotating grinding wheel surface consumes.

5. The blade sharpening machine according to claim 1, characterized in that said machine provides a rotating grinding wheel protection.

* * * * *